United States Patent [19]

Delehoy

[11] 3,980,245

[45] Sept. 14, 1976

[54] DISPENSER-HOLDER FOR A RING OF STICKER-TAPE

[75] Inventor: Billy G. Delehoy, Fort Collins, Colo.

[73] Assignee: Dekuh, Inc., Fort Collins, Colo.

[22] Filed: July 5, 1974

[21] Appl. No.: 486,116

[52] U.S. Cl. ..... 242/55.2; 242/96; 225/78

[51] Int. Cl.[2] ..... B65H 19/00

[58] Field of Search ..... 242/55.2, 68.2, 68.3, 242/136, 210, 85, 96; 225/46–48, 56–66, 78

[56] References Cited

UNITED STATES PATENTS

| | | | |
|---|---|---|---|
| 1,354,434 | 9/1920 | Fassoulis | 242/136 |
| 1,386,515 | 8/1921 | Larson | 242/136 |
| 2,792,184 | 5/1957 | Kresser | 225/47 |
| 2,963,208 | 12/1960 | Yates et al. | 225/78 |
| 3,272,452 | 9/1966 | Cohen | 242/210 |
| 3,278,133 | 10/1966 | Froehlich | 242/68.3 |
| 3,705,697 | 12/1972 | Chagnon | 242/85 |

*Primary Examiner*—Leonard D. Christian
*Attorney, Agent, or Firm*—Wilbur A. E. Mitchell

[57] ABSTRACT

An improved detachable wheel dispenser-holder unit, for a ring of pre-formed peripherally-tearable sticker tape, adapted to have portions thereof unwrapped and torn off its periphery from time to time, with the unit adapted for removable attachment to any member, animate or inanimate, having a wheel for peripheral mounting the sticker-tape ring thereon, and having a detachable holding means for so securing the unit. The wheel may be of a constant size or with an adjustable periphery, for increasing its periphery for a frictional holding of such a ring of tape of larger size than the wheel and peripherally thereon.

5 Claims, 8 Drawing Figures

DISPENSER-HOLDER FOR A RING OF STICKER-TAPE

BACKGROUND OF THE INVENTION

In various industries it has become increasingly important for the worker to apply strips of sticker tape of various kinds, such as masking tape for example, by a painter, to protect certain edges from being painted where he is working. A shipping clerk in a shipping department uses strips of such and other sticker tape, such as commonly called scotch brand tape, in accomplishing a permanent wrapping before shipping of items. In such usages, the tape comes from the manufacturer in the form of a relatively large ring, preformed as wrapped onto a cardboard ring, and is adapted to have parts thereof torn off of the outer periphery thereof as it is unwrapped as needed. The worker usually holds such a ring roll with one hand and tears off a piece with the other. So far as known, there has been no suitable dispensing attachment adapted for removable holding for use in certain places and under various conditions or circumstances for such commercial size ringspool rolls of such pre-formed sticker tape, and for permitting the tearing of pieces therefrom as needed. Such tape usually comes in a pre-formed ring-roll of from 3 to 6 inches inside diameter. Heretofore the worker has had to use both of his hands in handling the tape and in tearing pieces off when needed.

The prior art includes detachable reels, so far as known, only for use to wrap-on yarn crochet string, rope, line, wire and the like, and for unwrapping from a roll of such as string and yarn and wire, but there has been no provision for any such combination with a pre-formed ring roll of modern peripherally tearable sticker tapes, in modern uses thereof.

SUMMARY OF THE INVENTION

Applicant's invention is not of a spool on which to wrap a lengthy item, but, on the contrary, is a combination of a novel wheel dispenser for holding a preformed ring-spool of peripherally-tearable sticker tape, from which pieces thereof are torn from the periphery as needed from time to time, and with a means for detachably securing such a dispenser wheel to various members or objects. Further, Applicant combines an adjustable periphery of such a wheel of this dispenser-holder, for adapting it for use with variable sizes of such pre-formed ring-sticker tapes. Pre-formed peripherally-tearably rings of sticker-tapes come in variable size inside diameters (I.D.), as used in many modern industries and uses. A snap-friction or expandably detachable yoke band holder combination is one form for removably securing the wheel dispenser-holder unit, having such a ring of pre-formed sticker tape held on the wheel, with the yoke frictionally mounted to and held on any suitable object, animate or inanimate, adjacent the operator, to permit access to the tape and free use of both hands of the operator in his work. One such use is to snap-slip such yoke and band around the wrist of one of the arms of the operator, so as to have the roll of tape accessible to the operator, and yet for him to have free use of both of his hands in his work. Otherwise, the operator would have to use both of his hands, to pick up the roll of sticker tape and hold it with one hand and tear off a piece with the other hand, when he needs to tear off a piece of the tape for application to his work. Thus, with the use of such a holder method for carrying Applicant's dispenser holder unit, the operator may make more efficient use of his time, by only having to use one hand to tear off needed pieces from the periphery of the roll of sticker tape as needed, and the roll of tape is always accessible to him. To adopt the dispenser wheel for use with different I.D. size rings of such pre-formed sticker tape, the operator either increases or decreases the outside diameter size of the dispenser wheel, to the extent possible, as a result of the periphery of that wheel, being adjustable for changing that outside diameter, in effect, by members carried thereby. To adopt the periphery of the dispenser wheel to be able to recieve different I.D. size rings of such pre-formed tape, to be held thereon by a friction holding on the periphery of the wheel, it has been found desirable to alternately make either different size wheels for replacement or interchange of one for the other on a given axle, or to provide a modified wheel with a means to adjust its periphery, by an increasing or decreasing of its periphery, to thus use only one peripherally adjustable dispenser wheel, so as to adapt it for such a friction holding of various I.D. size rings of sticker tape frictionally on the periphery thereof. The dispenser holder wheel is rotatable, as desired, according to the tightness or resistance of its journal bearing mounting against rotation thereon, such as by a lock-washer being only partially under pressure, as may be desired, according to the operator's need for rotating the wheel from time to time to be able to unroll the sticker tape from the periphery and be able to tear pieces therefrom.

The snap or expandable yoke holder, carrying such dispenser wheel as a part thereof, may be secured to any member, either animate or inanimate, adjacent the operator or of the operator, such as to a painter's wrist or the rung or side of his ladder or adjacent object.

BRIEF DESCRIPTION OF THE DRAWINGS

Like reference numbers have been used to indicate like parts throughout the drawings.

DESCRIPTION OF THE PREFERRED EMBODIMENTS

Figure 1:
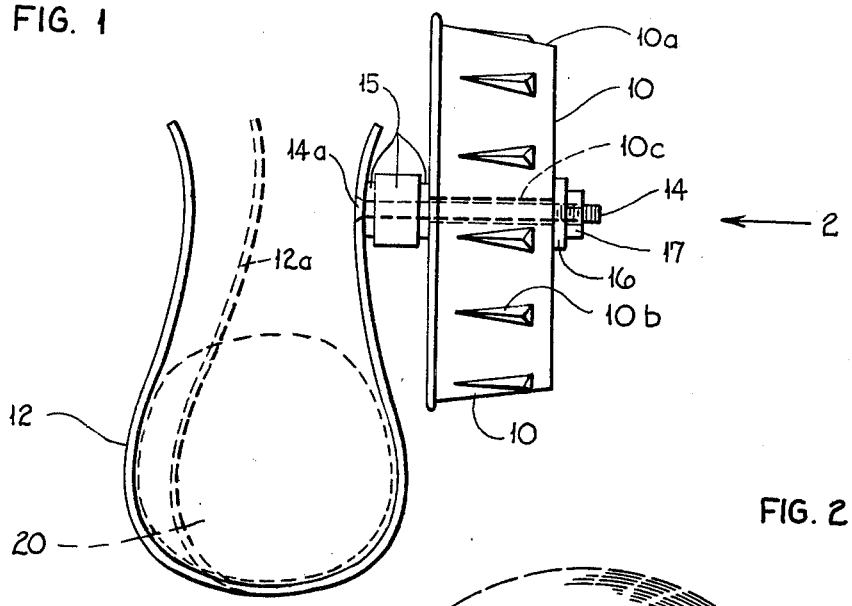
FIG. 1 is an elevational view of a first embodiment of the invention, and diagramatically illustrated as having a yoke holding means frictionally secured onto a human wrist.
Figure 2:
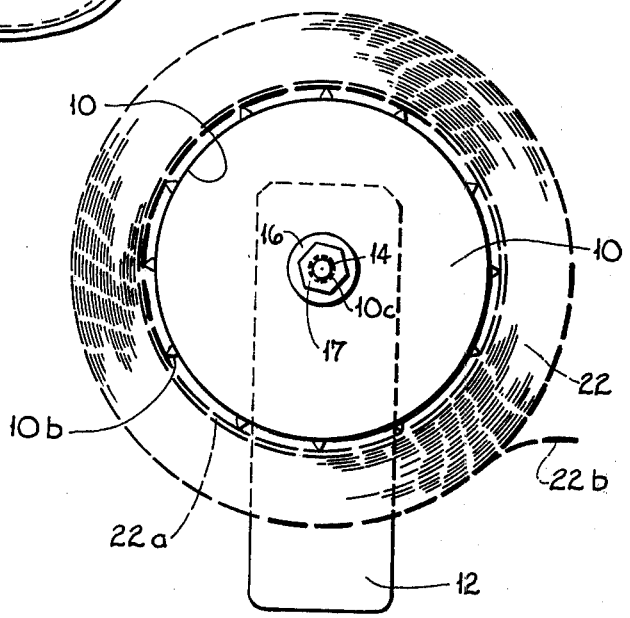
FIG. 2 is a side view thereof, in the direction indicated by the arrow 2 of FIG. 1, with the addition of a ring-roll of pre-formed sticker-tape peripherally inserted thereover and carried thereby.
Figure 3:
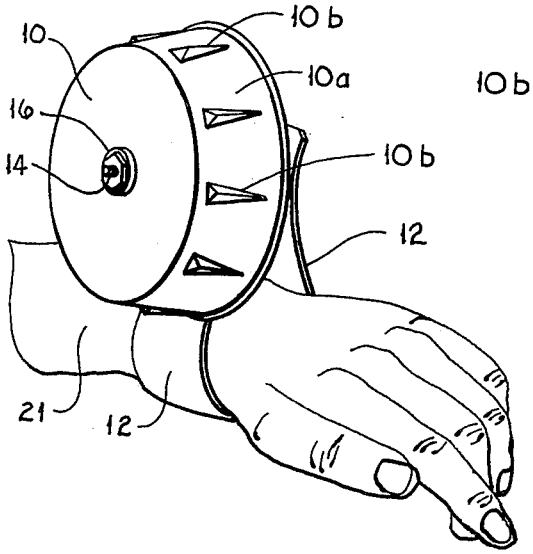
FIG. 3 is a reduced isometric view of the dispenser-holder unit shown in FIG. 1, held on an operator's wrist.

My preferred embodiment is shown in FIGS. 1, 2 and 3, and comprises a light-weight wheel 10, having an axial hole 10 formed through its center, so as to permit a rotatable mounting thereof on a stud bolt 14 extending through that opening. The wheel has a flat and slightly slanting transverse peripheral surface 10*a*, as shown, and that surface is provided with a plurality of raised friction ribs 10*b* extending radially outwardly therefrom, of the configuration shown. An expandable snap-on u-shaped spring yoke band member 12 carries the bolt 14 outwardly from an end thereof, as shown. Bolt 14 has a bevelled head 14*a*, counter-sunk inserted and conventionally held in on opening provided at the one end of one of the two arms 12*a* of that yoke 12. The bolt extends to the side and outwardly from 12, with the wheel 10 on the bolt for rotation of the wheel on the bolt. Suitable spacer washers 15 are placed on the bolt 14 to space the wheel 10 for revolution on 14 outwardly from the yoke 12, as shown. A nut 17 is then screw-secured onto the exterior threads of 14 at the outer end of bolt 14, after a lock-friction washer 16 has been placed on the bolt between the nut 17 and that side of the wheel 10. The rotatability of wheel 10 depends upon the extent or tightness of the tightening application of the nut 17 onto the thread end 14 of the bolt, for exerting a small amount of pressure thereby through the washer 16 against the side of the wheel 10 and in turn against washers 15. A fully tightened nut 17 on 14 would thus prevent rotation of the wheel 10, whereas only a slightly tightened application of 17 thereon is desirable, so as to permit a small manual rotation of the wheel 10 on its axis, for reason to be explained. FIG. 1 diagramatically illustrates an animate member 20 or wrist of a human arm, showing how the snap on yoke 12 is snap-applied on and over the wrist and is frictionally held thereon by the tension of the yoke 12. The normal position of the arm portions 12*a* of yoke 12, before such application to an arm, is indicated by the dotted line of FIG. 1. Thus the arms 12*a* of the yoke 12 are spread apart against their normal tension when the yoke is applied onto any member, such as a wrist, for affecting a frictional holding of the yoke to the object. A further illustration of the use of my yoke holder, for holding of the holder-dispenser, is shown as to a human wrist, by FIG. 3. It will be understood that this holder-dispenser attachment can be so frictionally applied over and held onto any other suitable member, or object, animate or inanimate, for a frictional holding thereof by the yoke 12.

Pre-formed ring peripherally-tearable, sticker-tapes 22 are conventionally manufactured, as far as known, in a ring formation, being wrapped on and around a suitable semi-rigid pressed paper or cardboard inner ring 22*a*. I frictionally wedge or press-mount and secure such a ring spool 22, of such pre-formed sticker tape, onto the periphery 10*a* of my wheel 10, and in the plane alignment of the wheel, as illustrated by the dotted lines 22 and 22*a* and 22*b* of FIG. 2. There is a resultant frictional fixed holding then of the sticker-tape ring 22 onto the periphery of the wheel 10, and as assisted in that holding by the raised spaced peripheral ribs 10*b*. The outer peripheral end 22*b*, of the roll 22 of this sticker tape is adapted for a manual grasping, and pulling and in tearing any desired length of the tape, after an unrolling of the part desired, as needed, and as may be accomplished with only the one hard of the other arm of the operator, when my dispenser holder attachment is used with the attachment being carried by the one arm of the operator. A slight revolution of the wheel 10, with the roll 22 thereon by a pulling of the end 22*a*, is accomplished with each such peripheral tearing of the piece therefrom, and which possible revolution of the wheel in that use is, as explained, controlled by the amount or extent of the tightness of the nut 17 on the bolt 14 through the lock washer 16.

Figure 5:
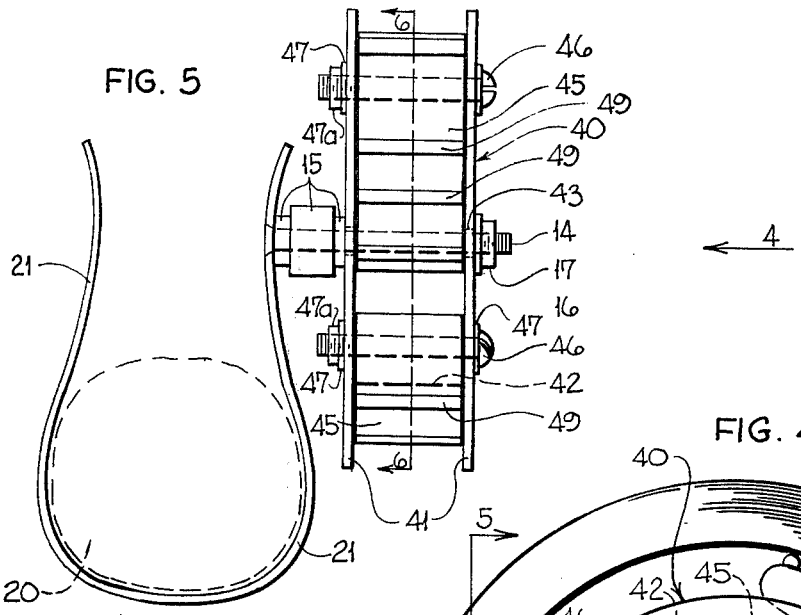
FIG. 5 is an elevational view of that modified dispensing wheel unit of FIG. 4, and with a diagramatic illustration of a human wrist to which it is frictionally attached and carried.
Figure 4:
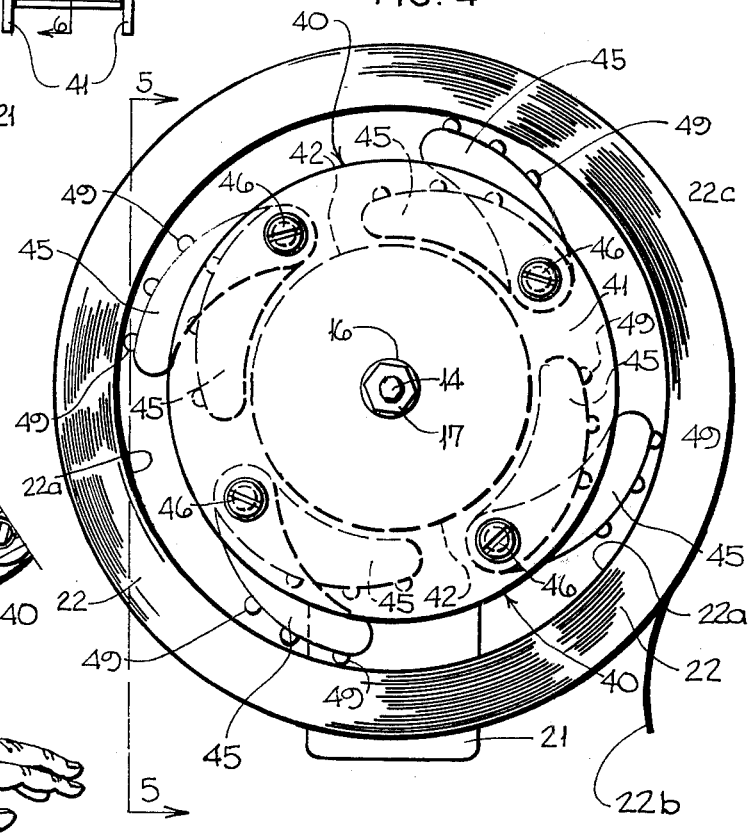
FIG. 4 is an elevational side view of a first modification of my invention, taken in the direction of arrow 4 of FIG. 5, wherein the dispensing wheel has a plurality of manually adjustable peripheral means for increasing the outside diameter of that wheel.
Figure 6:
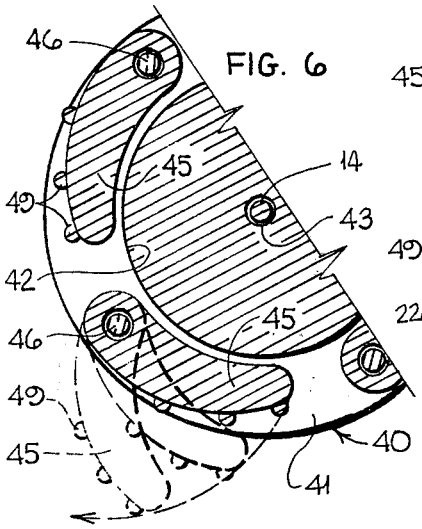
FIG. 6 is a partial cross-sectional diagramatic view, taken on the line 6—6 of FIG. 5 and looking in the direction of the arrows 6—6.

FIGS. 4, 5 and 6 are of an alternate wheel 40, used with my dispenser-holder attachment, instead of the prior fixed diameter wheel 10. Wheel 40 is constructed so as to have a manually adjustably substantially expansible periphery, by a plurality of manually adjustable means to increasingly vary the periphery size or diameter size of that wheel 40. This will adapt 40 for a holding and dispensing of different I.D. size sticker-tape rings 22, of a larger size than the normal diameter of the wheel 40, before such adjustable peripheral expansion. I make the wheel 40 of a pair of parallel plates or discs 41 held in alignment rigidly and spacedly apart, but held together as a unit in parallel arrangement by a suitable ring or inner hub 42, to form this wheel as illustrated in FIGS. 4, 5 and 6. Such discs 42 have an aligned axial central hole 43 formed through both, for securing the stud bolt 14 therethrough as an axle and for a rotatable mounting of wheel 40 thereon, with suitable spacer washers 15 and lock 16 and a securing nut 17 on 14, as before. I mount a plurality of three or more pivotally-swingable crescent segment members 45, between the plates 41 of the wheel 40, radially exteriorly of the inner hub 42, in equal spaced relationship around the 360° inner periphery of the wheel 40, as illustrated. Each pivoted segment 45 is suitably pivoted on parallel screw-pivot bolts 46, with each of said pivot bolts being carried by the plates 41 of the wheel 40, as shown. A lock washer 47 and a conventional nut are placed upon each screw bolt 46. Each of such crescent members 45 are substantially of a width equal to the inner distance between the plates 41 of the wheel, for a snug frictionally rotatable movement of each on its respective pivot 46. Upon a manual screw tightening of a nut 47*a* on its bolt 46 the adjacent abutting surfaces of the discs 41 will thereby be caused to compress towards each other and against the side edges of the crescent member 45 thereof, for thus holding 45 against rotation after manual placement of 45 in a desired position, by the plates 41, as shown in FIG. 4. A loosening of screw-bolt 46 and its nut 47*a* will permit 45 manual rotation on the bolt 46, for adjustment of 45 purpose, to effect a change of diameter of the periphery of the wheel 40, when desired to effect such different diameter, and then 46–47*a* are completely tightened. While I have illustrated four of the adjustable crescent segment members 45, it is to be seen that there may be as few as three thereof. Upon the use of three of such crescent members 45, it will be understood that they will be placed 120° apart, between the discs 41 and around the inner periphery of the wheel 40. When four of those adjustable peripheral crescents 45 are used, as illustrated in FIGS. 4, 5 and 6, they are each placed 90° apart around the periphery and between discs 41 of the wheel, as shown. By means of the manually pivotally adjustable peripheral crescent segments 45, on the periphery of the wheel 40, it will be seen that the periphery of that wheel can be enlarged by the operator making individually manual pivotal outward adjustment positioning of each of those crescent segments 45, by a losening of 46, 47*a* and 47 and then an outward positioning of each segment 45, and then a tightening of 46, 47 and 47*a* for a fixed new position of each segment, for adapting the outer surface of each of the crescent segments 45 to be an equal radiant distance from the center axis point of the wheel 40. That then permits a frictional mounting of a sticker tape ring 22 thereover, which is of larger I.D. than the outside diameter of wheel 40, as illustrated in FIG. 4, and to have a holding of that ring thereon in parallel relationship to the plane to the wheel 40. In such an outward fixed positioning of the outer edge of each pivot-segment 45, that outer edge of each 45 member frictionally fits against the I.D. cardboard inside 22*a* of the tape ring 22 for thereby accomplishing a rigid frictional holding of the ring on the wheel. In this modification I provide a plurality of suitable raised ribs 49 on the outer peripheral surfaces of each swingable crescent member 45, to assist in the frictional holding of the tape ring thereagainst, as the inner cardboard ring 22*a* of the ring 22 becomes slightly compressed around a rib 49 in that holding position, as the cardboard ring 22*a* is only semi-rigid. Such adjustable plurality of crescent segment members 45, just explained, provide a manually adjustable pivoted radial means on the the periphery of wheel 40 for substantially enlarging that periphery and for substantially enlarging the diameter of the wHeel at the same time. The friction ribs 49, on the outer surface of each segment 45, are peripherably made of a suitable non-friction material, such as neoprene.

Figure 8:
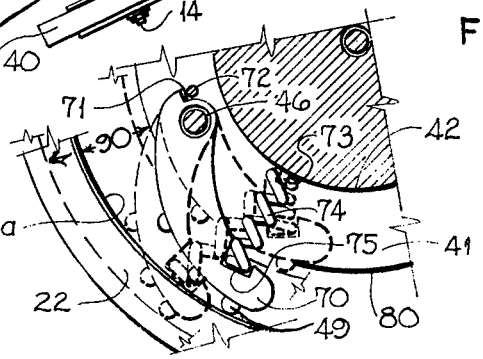
FIG. 8 is a partial diagramatic view of another modified adjustable peripheral dispensing wheel, for varying the outside diameter size of that wheel and for a dispenser-holding of a ring-sticker tape thereon and thereby.

As another alternate adjustable size dispensing wheel, for the sticker ring-tape dispenser-holder unit, I partially diagramatically illustrate an automatically peripherally adjustably enlargable wheel 80 by FIG. 8, by a variation in the construction and operation of each of the plurality of swingable adjustable pivoted crescent members on the periphery of the wheel 80. Wheel 80 is similarly constructed otherwise to wheel 40 of FIGS. 4 and 5, having plates 41 and inner hub 42. Instead of the manually peripherally adjustable segments 45, I provide automatically adjustable peripherally expandable means, 46, 70, 71, 72, 73, 74, and 75, for the wheel 80. A plurality of three or more adjustable pivoted crescent members 70 are provided, for the wheel of the same construction as the wheel of wheel 40 before, spaced, when three, 120° apart peripherally on the wheel and between the plates 41 thereof with the same pivotal mounting means 46 for each crescent 70. The crescent 70 is substantially of the same purpose, size and construction as was crescent 45 before, except that I design each crescent 70 with a stop shoulder 71 on its end adjacent its pivot 46, and which stop shoulder is spaced so as to abut against a stop post 72 provided there adjacent each pivot 46 to stop the rotational outward or clockwise movement of the segment 70, by the shoulder 71 striking thereagainst in a certain swingable positional extension movement of 70 on 46, as illustrated. Thus the stop shoulder and stop post limit the outer pivotal swinging extent of each crescent 70. Such outer pivotal swinging of each crescent 70 on its pivot 46 is accomplished by a suitable tensioned expansion coil spring 74 mounted to extend between an indentation 75, provided for the purpose on underside of a crescent 70, and a projection 73 or post provided for the purpose over which the spring fits on the adjacent periphery of the hub 42 surface of the wheel, as shown. Each spring 74 normally causes rotation of its crescent 70 on its pivot 46 outwardly until the stops 71 of 70 abuts against post 72 and thus prevents further rotation on the axis 46, so the formation and spacing of those stops with relation to each other is important. It is to be understood that there are at least three, though not illustrated, of each crescent 70 so mounted and spring actuated, on the periphery of that modification of the wheel 80, though there may be more than three thereof. In the event of more, they will be equally spaced apart about the periphery of the wheel. In this modification it will be seen that it will be possible to substantially enlarge the periphery of the wheel 80 automatically as a result of the individually spring swingable expansion of each segment 70 thereof, and the extent of such automatic peripheral enlargment adjustment of the wheel 80 is diagramatically illustrated by the reference numeral 90 of FIG. 8. The plurality of those segments 70 may be manually each compressed, to be in an equal radial position from the center axis of the wheel 80, for a frictional fixed holding of the inside of a variable size tape ring 22, as diagramatically illustrated by the dotted lines 22*a* of that FIG. 8. The tension of each expansible spring 74 is sufficient for an exertion of sufficient pressure outwardly thereby through each segment 70 to frictionally hold a sticker-tape ring 22 in the peripheral plane of the wheel 80 when such a ring is placed, as diagramatically illustrated, and as a fixed part of the rotatable wheel 80. In the use of this wheel 80, the operator places such a sticker-tape ring 22 in the plane of the wheel over the outer edges of the plurality of spring-actuated segments 70 thereof, by first manually depressing one or more of those segments 70 for permitting a placing of the ring-tape, with its interior 22*a* in alignment with the plane of the wheel while those certain of the segments 70 are depressed, on the wheel, and then the operator releases the depressed segments which he has been spring compressing, after such alighment, and the springs of the depressed segments automatically then pivot those segments to the fully outward swingable extent on their respective pivots as limited in their abutment against the I.D. of the newly placed ring 22. Each of the segments 70 have the same holding friction ribs 49 on the outer surface edges thereof, as illustrated, which assist in the frictional fixed holding of the ring on and as a part of wheel 80, as before. It will thus be seen that this wheel modification, of an automatically pivotally spring expandable peripheral crescents 70, normally expansible beyond the periphery of the wheel 80 to the extent possible, and as limited by the pivotal capability of each within the distance possible, as controlled by its stop elements 71 and 72, is capable of being adapted for a holding of any one of a plurality of different I.D. size sticker-tape rings, varying in I.D. size somewhere within and between the limits of such I.D. possible ring size as indicated diagramatically by the reference No. 90 of FIG. 8.

My preferred embodiment dispenser wheel 10, of FIGS. 1–3, are for use with a constant I.D. size preformed one of rings of sticker tapes of a uniform size, and where there is no need for individual dispensing any other size ring. Such one size wheel 10 for such dispensing may be of approximately four inches in diameter. I provide different size wheels 10, for interchange thereof on the axle 14, such as from two inches to six inches in diameter, when necessary, according to the size of rings 22 usage required.

To obviate the expense and time lost, of having to replace that wheel 10 of the unit shown in FIGS. 1, 2 and 3 with a such different size wheel, to accomodate such use to dispense different size I.D. sticker tape rings 22, I have the alternate manually adjustable dispenser wheel 40, illustrated in FIGS. 4, 5 and 6, wherein one wheel 40 is adapted, as explained, for manual adjustment of its periphery to accomodate varying needs for the dispensing of different I.D. size sticker tape rings thereby, and as illustrated diagramatically in FIGS. 5 and 6.

Further, as an efficient and time saving dispenser unit, a peripherally automatically adjustable size dispensing wheel is provided, as shown in FIG. 8, for the dispenser-holder unit in the form of a substantially automatically adjustable peripheral-size wheel. It will be understood that each spiral expansion spring ring 74 thereof is compressed and placed as shown, in the assemblying of that wheel unit. My wheel used in the two alternate modifications, FIGS. 4, 5, 6 of one, and FIG. 8 of the other, are of like construction, except that in FIG. 8 there is a post 73 and a stop 72, and each crescent member 70 is slightly changed, as shown and explained. The wheel discs 41 of 80 are assembled, as explained, by the inner hub 42, and then the stud-screw bolt 46 is placed through a hole in the one disc, then through the hole of a crescent 70 and then extends through an aligned hole of the other disc 41, with an appropriate lock-washer 47 and the nut 47*a* placed thereon, after the spring 74 is first placed in the illustrated position, so that the spring extends with one of its ends on and around the post 73 of 42 and then to and with its other end within the cavity 75 on the underside of the adjacent crescent 70, before said insert of said bolt 46.

Figure 7:
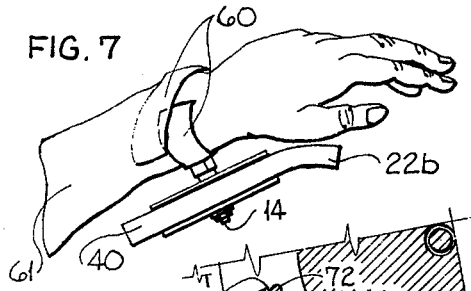
FIG. 7 is a reduced isometric view of said modified wheel dispenser unit and with a modified wrap-around sticker-strap holding means, for removable attachment and carrying thereof, shown as so attached to a human arm.

As an alternative removable holding means, for removably securing any of my pre-formed sticker-tape-dispenser units, I have diagramatically illustrated a wrap-around overlapping and removable sticker-strap 60, of FIG. 7, having a conventional sticker-mastic substance on its inner side adapted for a frictional removable securement to any object, animate or inanimate, and as there illustrated to a human arm wrist. While I have illustrated this holding means in use with the second modification of my wheel, it is, nevertheless, to be understood as also being usable with any modification. The shaft 14 is secured to that strap 60 and the dispensing wheel 40 is mounted on that shaft. The reason for this alternate fastening means, adapted for securement to any inanimate object, as well as to a human body, is because the operator often has need, as a painter, to affix the dispensing unit to a nearby available positioned object or surface, such as, and though not illustrated, the part of an automobile or the window sill of a house or ladder where the painter is working, as, when he is ready to paint the window sash in painting a house, he would want to apply protective masking tape to the window pane portion adjacent the window frame or sash before painting that frame, to prevent paint from getting on the glass.

Though not shown or described heretofore, it is to be understood that there may be other and sundry means as the method for providing for an expansible periphery of the wheel of my novel holder-dispenser, within the teaching of this invention; such as, there could be an inflatable peripheral tube held between the plates 41 of the wheel 80, exteriorly of the inner hub 42, whereby that tube could be inflated, similarly to an innertube of a tire, for thereby increasing the outside diameter of the wheel or the overall periphery of the dispenser wheel, whenever necessary to adjust the size of that wheel to meet the need for a frictional securement and holding of the inside diameter of such a different sized and larger sticker-tape ring. In the use of such an innertube expandable periphery, the sticker-tape ring to be held would be first placed in alighment over the plane of the wheel, and then that tube expanded by insert of air sufficiently to create an expanded pressure for the tube to frictionally abut against the inner side of the ring of the tape for thereby holding that ring against that tube in a substantially fixed position as a part of the wheel.

Having thus explained, illustrated and taught various possible modifications of my invention, I wish to be bound only within the scope of the hereunto appended claims.

I claim:

1. A dispenser-holder, for a ring-roll of pre-formed peripherally tearable sticker-tape, comprising, a wheel rotatably mounted on an axle, a holding means adapted for frictional removable attachment to an animate or inanimate object, an axle carried by the holding means and having said wheel so mounted thereon, and said wheel having its periphery adapted for frictionally fixedly carrying a roll of such sticker-tape thereon, and wherein the wheel periphery has a plurality of pivotally adjustably movable peripherally-expandable segment member means adapted for variably substantially increasing the periphery of the wheel for adapting the extended periphery for carrying a larger inside diameter ring-roll of such sticker-tape than the normal peripheral size of the wheel before such peripheral increase.

2. A pre-formed peripherally-tearable sticker-tape ring-roll dispenser-holder as set forth in claim 1 wherein said variably adjustable expandible peripheral means is a plurality of individually manually adjustable pivoted radial crescent means carried by the wheel periphery and in the plane of the wheel and each adapted for manual pivotal adjustment for fixedly substantially increasing the wheel diameter for adapting the wheel to carry a larger roll of such sticker-tape than would be possible before such diameter increase of the wheel.

3. A pre-formed peripherally sticker-tape ring-roll dispenser-holder as set fourth in claim 1, wherein the plurality of adjustable peripherally expandable segment member means are carried by the wheel periphery, a tensioned expansion spring means on and between the wheel and each segment member means, and the wheel and each segment of said member means having an adjacent stop member means adapted for limiting the extent of that pivotal expansion spring actuated pivotal movement beyond a pre-determined point, with each of said spring means having sufficient tension for causing sufficient pressure on their adjacent respective member segment means for causing a pivoting of its segment means and also for causing a surface of its segment means to frictionally press against and hold a ring of such tape on the extended wheel periphery of the plural segment member means, upon the inside of a ring of such tape being placed over said plurality of segment means in the plane of the wheel.

4. In a dispenser-holder for a roll of pre-formed peripherably-tearable sticker-tape, the combination of a dispensing wheel adapted to frictionally receive and hold a ring of such sticker-tape on the periphery of the wheel, a frictionally removable holding means adapted for frictional removable mounting to an object, an axle carried by and extending from the holding means and with said wheel being journaled for revolution on said axle, and said wheel having a plurality of manually operable peripherally expandable arm member means on the periphery of the wheel and adapted for operably increasing the periphery of the wheel and with said expandable means being normally carried in the plane of the wheel, whereby said wheel periphery may be enlarged upon expansion of said expandable arm member means for such frictional carrying of a larger inside diameter roll of such tape than the normal outside diameter of the wheel by said expandable arm member means.

5. In a dispenser-holder for a roll of pre-formed peripherably-tearable sticker-tape, the combination as set forth in claim 4, and wherein each of the peripheral expandable arm member means is expandable by an expansion spring means for so operably increasing the periphery of the wheel.

* * * * *

UNITED STATES PATENT OFFICE

CERTIFICATE OF CORRECTION

Patent No. 3,980,245 Dated September 14, 1976

Inventor(s) Billy G. Delehoy

It is certified that error appears in the above-identified patent and that said Letters Patent are hereby corrected as shown below:

Column 2, after line 41, insert the following paragraph:

-- Instead of the expandable-snap-yoke detachable band friction holder for a carrying of the dispenser wheel, other holding means are used, such as a removable sticker wrap-around-strap, for a removable fastening of the dispenser-holder unit to any desired object suitably available, such as to a part of an automobile body surface or other object, or the operator's arm or wrist. --.

Column 4, line 13, "hard" should read -- hand --.

Column 5, line 38, delete "the", second occurrence.

Column 5, line 41, "wHeel" should read -- wheel --.

Signed and Sealed this

Eighteenth Day of January 1977

[SEAL]

*Attest:*

RUTH C. MASON
*Attesting Officer*

C. MARSHALL DANN
*Commissioner of Patents and Trademarks*